US008641835B2

(12) United States Patent
Yamana et al.

(10) Patent No.: US 8,641,835 B2
(45) Date of Patent: Feb. 4, 2014

(54) IRON ALLOY, IRON-ALLOY MEMBER, AND PROCESS FOR MANUFACTURING THE SAME

(75) Inventors: Keita Yamana, Kariya (JP); Motoharu Tanizawa, Kariya (JP); Masanori Harata, Kariya (JP); Kyoichi Kinoshita, Kariya (JP)

(73) Assignee: Kabushiki Kaisha Toyota Jidoshokki, Aichi (JP)

( * ) Notice: Subject to any disclaimer, the term of this patent is extended or adjusted under 35 U.S.C. 154(b) by 97 days.

(21) Appl. No.: 13/123,466

(22) PCT Filed: Sep. 8, 2009

(86) PCT No.: PCT/JP2009/065670

§ 371 (c)(1),
(2), (4) Date: Apr. 8, 2011

(87) PCT Pub. No.: WO2010/041532

PCT Pub. Date: Apr. 15, 2010

(65) Prior Publication Data

US 2011/0192507 A1 Aug. 11, 2011

(30) Foreign Application Priority Data

Oct. 10, 2008 (JP) ..... 2008-263409
Jan. 9, 2009 (JP) ..... 2009-003186

(51) Int. Cl.

| | |
|---|---|
| ***C22C 38/06*** | (2006.01) |
| ***C22C 38/38*** | (2006.01) |
| ***C21D 8/00*** | (2006.01) |
| ***C21D 8/12*** | (2006.01) |

(52) U.S. Cl.
USPC ..... 148/306; 148/651; 148/653; 420/70; 420/103; 420/104

(58) Field of Classification Search
USPC ..... 420/79, 104; 148/306, 101–122, 651, 148/653, 621
See application file for complete search history.

(56) References Cited

FOREIGN PATENT DOCUMENTS

| | | | |
|---|---|---|---|
| JP | 51-6119 A | | 1/1976 |
| JP | 52-1683 B | | 1/1977 |
| JP | 59-1784 B2 | | 1/1984 |
| JP | 63-26337 | * | 2/1988 |
| JP | 04-063244 A | | 2/1992 |
| JP | 04-218614 A | | 8/1992 |
| JP | 06-100987 A | | 4/1994 |

(Continued)

OTHER PUBLICATIONS

Machine-translated Japanese patent 08-158012A, Yukio Tomita et al., Jun. 18, 1996.*

(Continued)

*Primary Examiner* — Deborah Yee
(74) *Attorney, Agent, or Firm* — Sughrue Mion, PLLC

(57) ABSTRACT

An iron alloy according to the present invention comprises: Al in an amount of from 3 to 5.5%; Mn in an amount from 0.2 to 6%; and the balance being iron (Fe), and inevitable impurities and/or a modifying element; when the entirety is taken as 100%. Since a high damping factor is obtainable at a low-strain amplitude, this iron alloy demonstrates a stable damping property even in a high-temperature region. Moreover, since the alloying elements are Al and Mn alone, and since their contents are less, the iron alloy according to the present invention is low in cost.

6 Claims, 4 Drawing Sheets

(56) References Cited

FOREIGN PATENT DOCUMENTS

| | | | |
|---|---|---|---|
| JP | 06-293943 | A | 10/1994 |
| JP | 07-242977 | A | 9/1995 |
| JP | 10-140236 | A | 5/1998 |
| JP | 2001-059139 | A | 3/2001 |
| JP | 2005-226126 | A | 8/2005 |
| WO | 2006/085609 | A1 | 8/2006 |

OTHER PUBLICATIONS

Machine-translated Japanese patent 2002-294408,Tatsuya Kumagai, Oct. 9, 2002.*

* cited by examiner

Loss Factor is Calculated by Half-value Width Method after Measuring Frequency Response Function $$\text{Loss Factor} \quad \eta = \frac{f_2 - f_1}{f_0}$$

IRON ALLOY, IRON-ALLOY MEMBER, AND PROCESS FOR MANUFACTURING THE SAME

CROSS REFERENCE TO RELATED APPLICATIONS

This application is a National Stage of International Application No. PCT/JP2009/065670 filed Sep. 8, 2009, which claims priority from Japanese Patent Application No. 2008-263409 filed Oct. 10, 2008, and Japanese Patent Application No. 2009-003186 filed Jan. 9, 2009, the contents of all of which are incorporated herein by reference in their entirety.

TECHNICAL FIELD

The present invention is one which relates to an iron alloy exhibiting a good damping property, or a soft magnetic property, and the like; to an iron-alloy member comprising that iron alloy; and to a process for manufacturing that iron-alloy member.

BACKGROUND ART

In an apparatus or instrument, and the like, which has a movable part that is capable of moving mechanically, the movable part becomes an oscillation source, and so it is often the case that vibrations arise more or less in various parts. Such vibrations are not preferable, because they make the cause of various noises, or lead to the degradation, and so forth, of fatigue strength. Hence, damping members that inhibit those vibrations have been used variously. For example, when being a member for which mechanical characteristics, such as strength and rigidity, are not required so much, and whose service environment (service atmosphere, for instance) is mild or gentle, a resinous member that is likely to absorb vibrations, or a workpiece using that resin partially (a damping steel board in which a resinous member is held between steel plates, for instance), has been used as a damping material.

However, such a damping member cannot be used easily for members for which mechanical characteristics like strength and so on are required, and which are employed in high-temperature atmospheres, and hence it is often the case a damping member comprising a metallic material has been used therefor. As for such a damping material, the following have also been proposed: a damping alloy that is based on Mn (e.g., Patent Literature No. 1); an iron alloy that includes expensive Co or Cr in a greater amount relatively (e.g., Patent Literature No. 2 or Patent Literature No. 3); and the like. However, such damping materials are not preferable, because the raw-material costs are higher.

Hence, iron alloys, which are less expensive relatively in terms of the raw-material costs as well as which are good in terms of the mechanical characteristics, such as the strength, the heat resistance and further the processability, and so forth, are proposed in Patent Literature Nos. 4 through 7 listed below.

Patent Literature No. 1: Japanese Unexamined Patent Publication (KOKAI) Gazette No. 7-242,977;

Patent Literature No. 2: Japanese Unexamined Patent Publication (KOKAI) Gazette No. 2005-226,126;

Patent Literature No. 3: Japanese Examined Patent Publication (KOKOKU) Gazette No. 52-1,683;

Patent Literature No. 4: Japanese Unexamined Patent Publication (KOKAI) Gazette No. 4-63,244;

Patent Literature No. 5: Japanese Unexamined Patent Publication (KOKAI) Gazette No. 6-100,987;

Patent Literature No. 6: Japanese Unexamined Patent Publication (KOKAI) Gazette No. 2001-59,139; and Patent Literature No. 7: International Publication Gazette No. WO2006/085,609

DISCLOSURE OF THE INVENTION

Assignment to be Solved by the Invention

However, even those conventional iron alloys that are given in the patent literatures do not necessarily make one which reduces the costs of the damping materials fully, because many of them are those which contain a variety of alloying elements in ample amounts. Moreover, in those patent literatures, clear notifications are hardly made on in what sort of regions the iron alloys are good in terms of the damping properties. According to investigations by the present inventors, it seems that those iron alloys are those in which damping properties are intended in relatively-larger-strain amplitude ranges, or in lower-frequency ranges.

The present invention is one which has been done in view of such circumstances. Specifically, it aims at providing an iron alloy that makes it possible not only to intend the reduction of production costs by reducing the alloying elements in species and in their contents but also to intend to effect a damping property in high-frequency ranges, or in low-strain amplitude ranges, to which attention has not been paid so much in conventional damping materials, and further iron alloy which is good in terms of the heat resistance (or the high-temperature stability of damping property) as well. Moreover, it aims at providing an iron-alloy member that comprises this iron alloy (e.g., damping members, or soft-magnetic members, especially), and a process for manufacturing the same in addition to the above.

Means for Solving the Assignment

The present inventors studied earnestly to solve this assignment; as a result of their repeated trial and error, they found out anew that an iron alloy, in which not only the alloying elements are limited to Al and Mn but also their contents are made less relatively, reduces vibrations in high-frequency ranges, or in low-strain amplitude ranges, effectively, and besides, its damping property is stable even in high-temperature regions. And, they arrived at completing the present invention being described below by developing this accomplishment.

<<Iron Alloy>>

(1) An iron alloy according to the present invention comprises:

aluminum (Al) in an amount of from 3 to 5.5% by mass (hereinafter being simply referred to as "%");

manganese (Mn) in an amount from 0.2 to 6%; and the balance being iron (Fe), and inevitable impurities and/or a modifying element;

when the entirety is taken as 100%; and it exhibits a good damping property, or a soft magnetic property.

(2) First of all, in the iron alloy according to the present invention, the indispensable alloying elements are two species, namely, Al and Mn, and besides, their contents are less relatively. Consequently, it is possible to reduce the production costs of the iron alloy that involve the raw-material costs.

Next, since the iron alloy according to the present invention is an iron alloy that includes Mn, namely, a reinforcement element; and since an overall amount of the alloying elements is an adequate amount, it is not only good in terms of the strength, rigidity, and the like, but also satisfactory in terms of the toughness, ductility, and so forth; and it is good in terms of the processability; and hence it is feasible to utilize it for various kinds of members.

Furthermore, according to results of investigations and studies that the present inventors made on the damping properties of members comprising the iron alloy according to the present invention (i.e., iron-alloy members), it was understood that those iron-alloy members reduce vibrations with low-strain amplitudes (e.g., from $1\times10^{-6}$ to $1\times10^{-5}$, for instance) effectively in a high-frequency range. For example, it was understood that a loss factor ($\eta$), which indexes an attenuating property in a high-frequency range (e.g., from 1,000 to 15,000 Hz) having such a low-strain amplitude (i.e., from $1\times10^{-6}$ to $1\times10^{-5}$), becomes 0.01 or more, 0.013 or more, 0.015 or more, 0.017 or more, and 0.019 or more, and further it even becomes 0.02 or more. Note that this loss factor was found by means of a central oscillation method (see FIG. 1). Specifically, the loss factor is a proportion of a differential value (i.e., $\Delta f=f\mathbf{2}-f\mathbf{1}$) between measured frequencies (i.e., f1, and f2), which are measured at the opposite ends of a test specimen (i.e., an iron-alloy member), with respect to an oscillation frequency (f0), which the test specimen exhibited at the center when being oscillated with a variety of frequencies, (i.e., $n=\Delta f/f\mathbf{0}=(f\mathbf{2}-f\mathbf{1})/f\mathbf{0}$). A specific method of the measurement will be described later.

For reference, as indexes for specifying the capability of attenuating vibrations, the logarithmic decrement $\delta$, the specific damping capacity W, and the like, are available, in addition to the loss factor $\eta$ that is used principally in the present description. These have relationships one another, and can be correlated with each other by means of a relational expression like $\delta=\pi\eta$ or $W=2\pi\eta$. Therefore, even in a case where the indexes for the capabilities of attenuating vibrations differ, it is feasible to compare them with each other by means of converting them mutually using those relational expressions.

And, in the iron alloy according to the present invention, it is needless to say that such a good damping property is being stabilized in low-temperature regions, and in an ordinary-temperature region; furthermore, it is being stabilized even in high-temperature regions (up to about 300° C. approximately at the lowest), and so the heat resistance (or the high-temperature stability of the damping property) is high. Therefore, even in this regard, it is feasible to utilize the iron alloy according to the present invention for more various kinds of members than ever before.

(3) By the way, although the following mechanism or reason is not necessarily clear: why the iron alloy according to the present invention (involving the "iron-alloy member," and so hereinafter being simply referred to as "iron alloy" whenever it is appropriate) demonstrates such a good damping property as aforementioned, it is believed at present as described below.

First of all, a damping property is such a phenomenon that the energy of vibration is partially absorbed, and the like, inside a damping material and is then lowered, thereby hindering the transmission of vibration. For reference, the absorbed vibrational energy is converted into a thermal energy principally, and is then emitted to the outside.

As such a mechanism for reducing vibrational energy (or damping mechanism), it has been said that the following types are available: ferromagnetic types where vibrations are absorbed by means of the migration of magnetic-domain walls (or boundaries between magnetic domains); dislocation types where vibrations are absorbed by means of the movement of dislocations in metallic crystals; twinned-crystal types where vibrations are absorbed by means of the movement of twin crystals that generate in martensitic transformations; composite types where vibrations are absorbed by means of viscous flow in the vicinity of the interface between a matrix (such as Fe) and dispersion particles (such as graphite); and the like.

It seems that a plurality of the mechanisms are merged together so that the iron alloy according to the present invention demonstrates a good damping property. From the viewpoint of the composition of its components, it seems to be a ferromagnetic type where vibrations are absorbed primarily by means of the migration of magnetic-domain walls. In reality, however, it is believed that the iron alloy according to the present invention to which plastic processing is applied further absorbs vibrations by means of the movement of dislocations as well.

Note that the present inventors have ascertained that a damping property is changed by means of coercive force, and that the more the coercive force of iron alloy decreases the more the damping property (or loss factor) augments. Investigations are currently underway on the correlation between dislocations and damping properties, and further on other damping mechanisms.

<<Iron-Alloy Member>>

(1) The aforementioned iron alloy according to the present invention also involves workpieces (or iron-alloy workpieces) prior to processing, in addition to members (or iron-alloy members) to which desired configurations are given by doing plastic processing, and the like. Although its intended uses are not necessarily limited, it is natural that the iron-alloy members are suitable for damping members, as can be apparent from such a good damping property as mentioned above.

(2) In reality, however, one of principal damping mechanisms in the iron alloy according to the present invention is believed to be one which is accompanied by the displacement of magnetic-domain walls. In fact, it has been ascertained that the iron alloy according to the present invention actually demonstrates a good soft magnetic property.

Since this characteristic is one which is in no way inferior to those of pure iron, Fe—Si alloys, and the like, namely, soft-magnetic materials that have been used heretofore, the iron-alloy member according to the present invention is suitable for soft-magnetic members as well.

Thus, the iron alloy according to the present invention is not only good in terms of the damping property alone, but also it is also good from the viewpoint of the mechanical characteristics such as the soft magnetic property and strength, and besides, it is obtainable inexpensively relatively. Therefore, not being confined to simple soft-magnetic materials, the iron alloy according to the present invention can be expected to be utilized in various kinds of fields.

(3) In addition, as one of the good magnetic characteristics of the iron alloy according to the present invention, being smaller in magnetic strain, that is, being smaller in the correlation between the strains and magnetic characteristics of the iron alloy, is available. Consequently, in accordance with the iron-alloy member according to the present invention, the magnetic characteristics (e.g., the displacement of magnetic-domain walls) are not affected substantially, and thereby a soft magnetic property or damping property can be demonstrated stably, even in a case where vibrations, strains or magnetic fields, and the like, are applied to the iron-alloy member; and moreover a good dimensional stability is obtainable.

<<Process for Manufacturing Iron-Alloy Member>>

The present invention can be grasped not only as the above-described iron alloy or iron-alloy member, but also as a process for producing or manufacturing the same.

Specifically, it is advisable that the present invention can also be a process for manufacturing iron-alloy member being characterized in that it is equipped with:

a hot working step of performing plastic processing onto an iron-alloy workpiece, which comprises: aluminum (Al) in an amount of from 3 to 5.5%; manganese (Mn) in an amount from 0.2 to 6%; and the balance being iron (Fe), and inevitable impurities and/or a modifying element; when the entirety is taken as 100%, at a hot working temperature that is equal to or higher than a recrystallization temperature of the iron-alloy workpiece; and an annealing step of heating the iron-alloy workpiece that is after being subjected to the hot working step to an annealing temperature that is higher than or equal to said recrystallization temperature, and thereafter cooling it gradually;

wherein an iron-alloy member that is made by forming said iron-alloy workpiece as a desired configuration is obtainable.

<<Others>>

(1) The "modifying element" being referred to in the present description is an element other than Fe, Al and Mn, and is an element that is effective in improving the characteristics of iron alloy. Although the types of characteristics to be improved do not matter at all, the following are available: damping property, soft magnetic property, toughness, ductility, high-temperature stability, and the like. As a specific example of the modifying element, Ni in an amount of from 0.5 to 1% by mass, and so forth, is available. Since Ni is an element that upgrades the strength of iron alloy, the advantage is effected barely when being too little; whereas the resulting vibration-attenuating capacity might possibly be declinable when being too much. The respective elements can be combined with each other arbitrarily. The contents of these modifying elements are not limited to the exemplified ranges. Moreover, their contents are usually a trace amount, respectively.

(2) Furthermore, according to the studies and investigations made by the present inventors, it was understood that Cr upgrades the damping property of the iron alloy according to the present invention considerably in a low-strain amplitude range at least. Too little Cr is not preferable because the advantage of Cr, which results in upgrading the damping property of the present iron alloy, is effected poorly; whereas too much Cr is not preferable because cost increases arise in the resulting iron alloys when Cr becomes too much. Note that, when Cr becomes too much, it seems that there might also be such a case where decline in the resultant damping properties might possibly be likely to occur because the a phases come to be generated. According to the experiments made earnestly by the present inventors repeatedly, it was ascertained that the resultant damping property becomes higher sufficiently when Cr falls in a range of from 1 to 8% at least.

(3) The "inevitable impurities" are impurities that are included in a raw-material powder, and are impurities, and the like, which are mixed accidentally during the respective steps; and are elements that are difficult to remove in view of costs, or due to technical reasons, and so forth. In the case of being an iron alloy that is directed to the present invention, carbon (C), phosphorus (P), sulfur (S), and so on, are available therefor, for instance. Note that, as a matter of course, the compositions of modifying elements and inevitable impurities are not limited in particular.

(4) Unless otherwise specified especially, the designations, namely, "from 'x' to 'y'" being referred to in the present description, involve the lower limit, "x," and the upper limit, "y." Moreover, the upper limits and lower limits being set forth in the present description are combinable arbitrarily, and are thereby able to constitute such a range as "from 'a' to 'b'." In addition, it is possible to set numerical values, which are selected arbitrarily from within ranges of numeric values, at the upper and lower limits, respectively.

(5) In the "iron alloy" or "iron-alloy member" being referred to in the present description, its form does not matter at all. In particular, it is even allowable that the iron alloy can be a workpiece that has a bulk shape, a plate shape, a rod shape or a tube shape, and the like, for instance, or it is also permissible that it can have a final configuration or can even be a structural member per se that can approximate it.

Moreover, although it is advisable that iron-alloy workpieces making those workpieces can be melt-produced materials, or they can even be sintered materials, dense workpieces with stable qualities are obtainable inexpensively when being melt-produced materials. Meanwhile, when being sintered materials, iron-alloy workpieces are obtainable by means of (near) net shaping in such states that can be approximated to their final-product configurations.

BEST MODE FOR CARRYING OUT THE INVENTION

Figure 1:
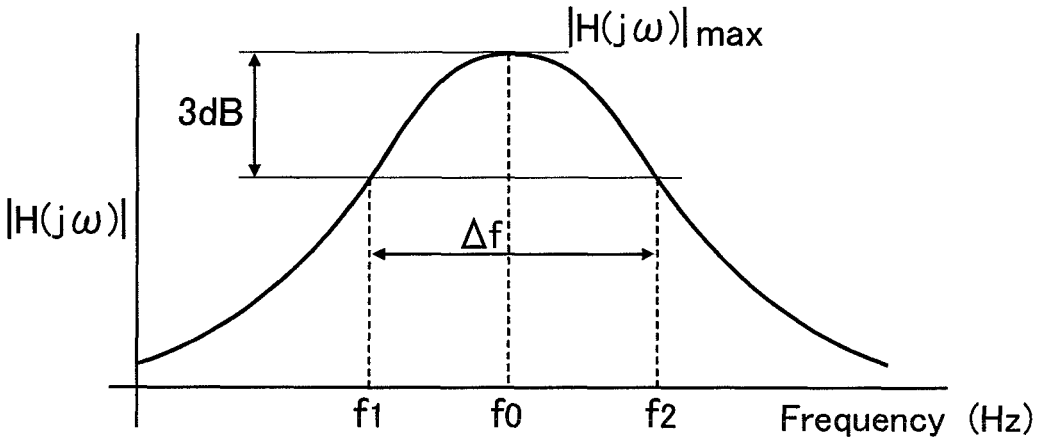
FIG. 1 is an explanatory diagram that illustrates a method of calculating loss factors that index a damping property.

The present invention will be explained in more detail while giving some of embodiment modes for the invention. Note that, involving embodiment modes below, contents being explained in the present description can be appropriately applied not only to the iron alloy that is directed to the present invention, but also to the iron-alloy member and the process for manufacturing the same. Consequently, constitutions, which are selected from those set forth below, are addable to either one of the inventions, and are further addable to the above-described constitutions according to the present invention beyond the categories in a superimposed manner or arbitrarily. For example, when being one of the constitutions that relate to a composition of the iron alloy, it can be relevant to the production process for the same, too, as well as to the iron-alloy member naturally. Moreover, although it appears at first glance to be a constitution that relates to a "manufacturing process," it can be turned into a constitution that relates to an "iron alloy" when comprehending it as a product-by-process. Note that whether any one of the embodiment modes is considered best or not depends on subject matters, their required performance, and so forth.

<<Alloy Composition>>

An iron alloy, iron-alloy member and iron-alloy workpiece (being simply referred to as "iron alloy" hereinafter) according to the present invention comprise Fe, namely, the major component, Al, and Mn. Concretely speaking, the iron alloy according to the present invention comprises Al in an amount of from 3 to 5.5%, Mn in an amount of from 0.2 to 6%, and the balance being Fe and inevitable impurities and/or a modifying element. As described above, Cr is effective as a modifying element, and so it is preferable that Cr can be included in an amount of from 1 to 8% at least. Since the inevitable impurities have been discussed as described previously, explanations on them will be omitted herein.

(1) Al

Al is an effective element in upgrading the damping property, and additionally is an effective element in upgrading the soft magnetic property. It is not preferable when Al is too little, because no sufficient damping property is obtainable; and it is not preferable when Al is too much, because the resulting iron alloys become more brittle and hence cracks become likely to occur in cold working (such as cold rolling) them, and because their damping properties also have a tendency to decline. Although the compositional ratio of Al is selectable arbitrarily within the aforementioned numerical range, it is preferable especially that numerical values, which are selected arbitrarily from the group consisting of 3.3%, 3.5%, 3.7%, 4%, 4.3%, 4.7%, 5% and further 5.3%, can make the upper and lower limits of that compositional ratio.

(2) Mn

Mn is also an effective element in upgrading the damping property and in upgrading mechanical properties (e.g., strength especially), and additionally effects an advantage of reducing the coercive force, and so is able to upgrade the soft magnetic property. Note that the advantage of reducing the coercive force can moreover be an advantage of upgrading the damping property as well.

Mn being too little is not preferable because no sufficient damping property is obtainable, whereas Mn being too much is not preferable because it results not only in high costs but also in lowering the damping property. Although the compositional ratio of Mn is selectable arbitrarily within the aforementioned numerical range, it is preferable especially that numerical values, which are selected arbitrarily from the group consisting of 0.25%, 0.3%, 0.5%, 0.7%, 1.5%, 2%, 2.5%, 3%, 4%, 5% and further 5.5%, can make the upper and lower limits of that compositional ratio.

(3) Cr

Cr is an effective element in remarkably upgrading at least the damping property of the above-described Fe—Al—Mn-system alloy. Although the compositional ratio of Cr is selectable arbitrarily within the aforementioned numerical range, it is preferable especially that numerical values, which are selected arbitrarily from the group consisting of 1.5%, 2%, 2.5%, 3%, 3.5%, 4%, 4.5%, 5%, 5.5%, 6%, 6.5%, 7% and further 7.5%, can make the upper and lower limits of that compositional ratio.

<<Manufacturing Process>>

(1) Iron-Alloy Workpiece

As far as one which has the above-described composition, it is advisable that an iron-alloy workpiece can even be melt-produced materials, and can even be sintered materials. In reality, however, since the damping property, soft magnetic property, mechanical characteristics, and the like, of iron alloy might possibly be lowered by means of the intervention of oxides, and so forth, it is preferable that an iron-alloy workpiece can be one which is made by casting or sintering in an oxidation preventive atmosphere, and further in a vacuum atmosphere.

(2) Plastic Processing

As a method of plastic processing that is directed to the manufacturing process according to the present invention, steps of hot working, and steps of cold working are available.

A step of hot working is a step in which plastic processing is performed onto an iron-alloy workpiece that is held in such a state that it is heated to the recrystallization temperature or higher. Such plastic processing can be hot rolling, hot forging, and the like, for instance.

Although a temperature (or hot-working temperature) at which this hot-working step is carried out can be a recrystallization temperature or higher, it is preferable that the temperature can be from 850 to 1,150° C., and further from 950 to 1,100° C., for instance.

A step of cold working is a step in which plastic processing is performed onto an iron-alloy workpiece at a cold-working temperature that is less than its recrystallization temperature. By means of this, the iron-alloy workpiece turns into a configuration of the final product (i.e., iron-alloy member), or a configuration that approximates it. As for such cold working, various kinds of processes, such as punching, bending and drawing, are available in compliance with specifications of the resulting iron-alloy members.

Although this cold-working step is not an indispensable step to the manufacturing process according to the present invention, it is an effective step in a case where an iron-alloy member whose specifications have been determined is mass-produced inexpensively. The cold-working step is usually carried out after a hot-working step, and is done before an annealing step being described later.

Since a magnitude of processing that is carried out in these hot-working step and cold-working step depends on the size of an iron-alloy workpiece and on the size of a final iron-alloy member, it is not necessarily possible to specify it explicitly, it has been ascertained that that processing magnitude has an influence on the damping property of iron alloy as well. This is believed to result from the following: processing strains, dislocations, and the like, which are introduced into an iron-alloy workpiece or iron-alloy member, are increased by means of increasing the processing magnitude; moreover, crystalline particle diameters also become smaller; and hence the mobility of magnetic domain walls that absorb vibrational energies, and the density of the dislocations, and so forth, have changed.

As one which indexes the processing magnitude in a hot-working step, a rolling reduction (e.g., difference in thickness before and after working/thickness before working) is available. In the iron alloy according to the present invention, it is allowable to set this rolling reduction so as to fall in a range of from 50 to 90%, and further from 60 to 80%.

(3) Annealing Step

A step of annealing is a step in which the iron-alloy workpiece after plastic processing is heated to an annealing temperature that is equal to or higher than its recrystallization temperature, and thereafter is cooled gradually. By means of this, it is possible to remove or decrease process strains, dislocations and the like that have been introduced by plastic processing prior to this step. Although this annealing temperature can be a recrystallization temperature or higher similarly to the above-described hot-working temperature, it is preferable that the annealing temperature can be from 850 to 1,150° C., and further from 950 to 1,100° C., for instance.

The annealing step is completed by means of cooling the iron-alloy workpiece gradually from this annealing temperature. It is advisable to carry out this gradual cooling by furnace cooling that uses a heating furnace. It is preferable that its cooling rate can be from 1 to 10° C./min., and further from 2 to 5° C./min.

In reality, however, it is not necessarily possible to explicitly specify to what extent the annealing temperature and the subsequent cooling rate can be set. The more sufficiently annealing is carried out the easier the displacement of magnetic domain walls becomes, and so it is believed that the soft magnetic property and damping property upgrade accordingly. However, in a case where not only a ferromagnetic type but also a dislocation type are taken into consideration as for a damping mechanism, there might possibly arise such an instance that it is more preferable that dislocations can exist more or less in an iron-alloy workpiece, and hence it is preferable to determine the particulars of an annealing step while taking this viewpoint into consideration.

<<Iron-Alloy Member>>

In the iron-alloy member according to the present invention, its configurations, usages, and the like, do not matter at all; however, the above-described damping member and soft-magnetic member are available as some of the examples.

(1) When listing specific examples that are directed to the damping member, it is possible to give vibrational cushions that are interposed between vibrating parts in internal combustion engine. More concretely speaking, the following are available: oil pans, inlet pipes, head covers, and the like; in addition to washers that are fitted to bolts for fixing an engine oil pan to a cylinder block to intervene between the engine oil pan and the cylinder block, washers that intervene between an injector for fuel and a cylinder head, and washers that intervene between an insulator for shielding heat emitted from engine and bolts for fixing the same.

Note that, since the iron-alloy member according to the present invention is good in terms of the heat resistance (e.g., the high-temperature stability of damping property), its damping property hardly declines up to 300° C. approximately even when being employed in various members for engine that become high temperatures.

(2) When listing specific examples that are directed to the soft-magnetic member, the following are available: magnetic cores that are used in all sorts of electromagnetic devices, such as motors and transformers; magnetic-circuits forming members, such as connector irons (or yokes); magnetic heads in hard-disk drives; magnetic shields; and the like.

By the way, as a scale for indexing a magnetic property of the soft-magnetic member according to the present invention, a coercive force is available. It is preferable that the coercive force can be 56 A/m or less (or 0.70 Oe or less).

Since the iron-alloy memberaccording to the present invention has Fe as the base, it is also good in terms of all sorts of mechanical properties, such as strength, rigidity, toughness and elongation, in addition to the damping property and soft magnetic property as described above. For example, since the tensile strength is as high as 360 MPa, it is of high strength sufficiently. Moreover, since the rigidity is also high, it can have a longitudinal elastic modulus (or Young's modulus) as high as 170 GPa approximately.

In this way, it is fully feasible to utilize the iron alloy according to the present invention as structural members because it is good in terms of all sorts of mechanical characteristics. Therefore, when substituting the iron-alloy member according to the present invention for conventional structural members, it becomes feasible for them to be accompanied with the above-described damping property, soft-magnetic property, and the like, as well.

Examples

The present invention will be explained in more detail while giving examples.

<<Manufacture of Test Specimens>>

(Melt Producing Iron-Alloy Workpieces)

Ingots of pure Fe, pure Al, pure Mn and pure Cr were made ready as raw materials, and were then blended so as to make various alloy compositions shown in Table 1, Table 2 and Table 3. These blended raw materials were put in a crucible made of alumina, respectively, and were then melted in a high-frequency vacuum melting furnace. This melting was carried out in an atmosphere that was made as follows: (i) the furnace was vented down to a pressure of from 0.1 to 0.5 torr (i.e., form 13.322 to 66.661 Pa); (ii) an Ar gas was thereafter introduced into the furnace up to 100 torr (i.e., 13,332.2 Pa); and, after degassing the furnace, the Ar gas was further introduced into it up to 500 torr (i.e., 66,661 Pa). On this occasion, the melting temperature was set at 1,530° C., and the molten metals were prepared in an amount of 500 kg, respectively, in a one-time melting operation.

The thus obtained iron-alloy molten metals were poured into a casting die made of cast iron under an argon-gas atmosphere, and were then solidified by means of natural cooling. Thus, test-specimen workpieces (or iron-alloy workpieces) with a columnar configuration (e.g., $\phi 70 \times T$ 130 mm) were obtained.

(2) Hot-Working Step

With respect to these test-specimen workpieces, hot rolling (i.e., plastic processing) was performed under an air atmosphere (i.e., a hot-working step). Before this rolling, heating (or afterheat) had been carried out at 1,000° C. for 1 hour in advance. At the time of rolling, the rolling reduction (e.g., {(Thickness before Rolling)−(Thickness after Rolling)}/(Thickness before Rolling)) was set at 75%.

(3) Annealing Step

After the test-specimen workpieces after being hot rolled were put in a heating furnace with an air atmosphere and were then heated to 1,050° C. they were furnace cooled down to ordinary temperature while taking about 5 hours of time. On this occasion, the cooling rate was set at about 3° C./min.

Via the steps as above, plate-shaped test specimens (e.g., 10 mm in width×160 mm in length×3 mm in thickness) were obtained eventually.

<<Measurements>>

(1) Using the aforementioned various test specimens, their loss factors were measured by means of a centrally oscillating method. The centrally oscillating method is a method in which a test specimen is supported at the center by a triangular jig; a predetermined vibration is then applied to that triangular jig; and frequencies of the vibration that are transmitted to the test specimen are measured. The vibration being applied in the present examples exhibited a frequency of from 1,000 to 10,000 Hz (e.g., a random noise), and the strain amplitude was set to fall in a range of from $1\times10^{-6}$ to $1\times10^{-5}$.

Frequency response functions within the aforesaid frequency range were found while changing the frequency. Loss factors were calculated by means of a half-value width method from those frequency responsive functions. An outline of this calculation method is illustrated in FIG. 1.

(2) Tensile strengths of the respective test specimens, and 0.2% proof stresses as well as elongations thereof were measured by means of a tensile test.

(3) Magnetic characteristics of the respective test specimens were measured by means of a direct-current self-recording magnetic fluxmeter.

<<Evaluations>>

Results of the various measurements that were made as described above were shown in Table 1, Table 2 and Table 3 combinedly. Note that the loss factors being shown in these tables are those which secondary resonance peaks that appeared when the frequency was at around 2,200 Hz were analyzed.

(1) Damping Property

<Influences of Mn and Al>

As can be apparent by observing Table 1, the loss factor augmented when Mn was included even in a small amount; and it was understood that the damping factor of the iron alloy was upgraded by means of containing Mn when the Al amount was an identical amount. In reality, however, when the Mn amount was made too much up to 8% approximately, it was ascertained that the loss factors tended to show a declining tendency conversely. Concretely speaking, when a comparison was made between Test Specimen No. 14 and Test Specimen No. 15, it was understood that a relative maximum of the loss factor existed when the Mn amount fell between 5 and 8%. Hence, in the present invention, the upper limit of the Mn amount is set at 6%.

Moreover, it was understood that the damping property of the iron alloy upgraded when the Al amount increased, because the loss factor increased remarkably. In reality, however, when the Al amount was made too little down to 2% approximately, no sufficient loss factor was obtainable.

Here, as can be ascertained when comparing Test Specimen No. 5 with Test Specimen No. 1 and comparing Test Specimen No. 5 with Test Specimen No. 11, the formers were roughly twice as large as the latters in terms of the increasing magnitude in the loss factor with respect to the increasing magnitude in the Al amount. When considering from this viewpoint, it is ascertained that the loss factor increased sharply while the Al amount changed from 2% to 3%. Hence, in the present invention, the lower-limit value of the Al amount is set at 3%.

On the other hand, as can be apparent when comparing Test Specimen No. 8 with Test Specimen No. 11, the loss factor decreased through the increase in the Al amount. Therefore, when observing this viewpoint alone, it may seem as well that a relative maximum of the loss factor appeared when the Al amount fell between 4 and 5%.

However, as can be apparent when comparing Test Specimen No. 6 with Test Specimen No. 10, the loss factor of Test Specimen No. 12 whose Al amount was 5% showed the maximum value when Mn was added only in an amount of 1% approximately. If so, when considering the Al amount on the premise of the existence of the Mn amount like the present invention, it is not appropriate to simply set the upper-limit value of the Al amount so as to fall between 4 and 5%.

Hence, in the present invention, the upper limit of the Al amount is set at 5.5%, because of the fact that the loss factor of Test Specimen No. 12 whose Al amount was 5% was the largest in the present examples.

<Influences of Cr>

As can be apparent when observing Table 2, it was understood that the loss factor of any one of the iron alloys being labeled Test Specimen Nos. 2-1 through 2-10 also augmented. Putting this together with later-described measurements shown in Table 3, it was ascertained that the damping property of the resulting iron alloy upgraded when Cr fell in a range of from 1 to 8% at least as far as Al fell in a range of from 3 to 5% and Mn fell in a range of from 1 to 8%.

In particular, when comparing Test Specimen No. 12, whose loss factor was the largest in the iron alloys that did not include any Cr, with Test Specimen Nos. 2-5 through 2-8, which further included Cr on the contrary to the former but which had the same compositions in view of Mn and Al, it was understood that, in the case of the iron alloys in which Cr was included, the loss factor, which had been large originally, became much larger markedly.

Moreover, it also became apparent that, excepting Test Specimen No. 2-1 whose total amount of Al and Mn was less relatively, any one of the iron alloys according to Test Specimen Nos. 2-2 through 2-10 exhibited a damping property that was equal to or better than that of above-described Test Specimen No. 12, because the loss factor exceeded 0.02 in any one of Test Specimen Nos. 2-2 through 2-10.

In addition, a preferable compositional range of Cr will be described in detail. Table 3 shows results of measuring loss factors with use of iron alloys that were made by varying the contents of Cr in Test Specimen Nos. 2-1 and 2-3. Relationships between the Cr contents and the loss factors, which were obtained from those measurement results, are illustrated in FIG. 4 and FIG. 5.

Figure 4:
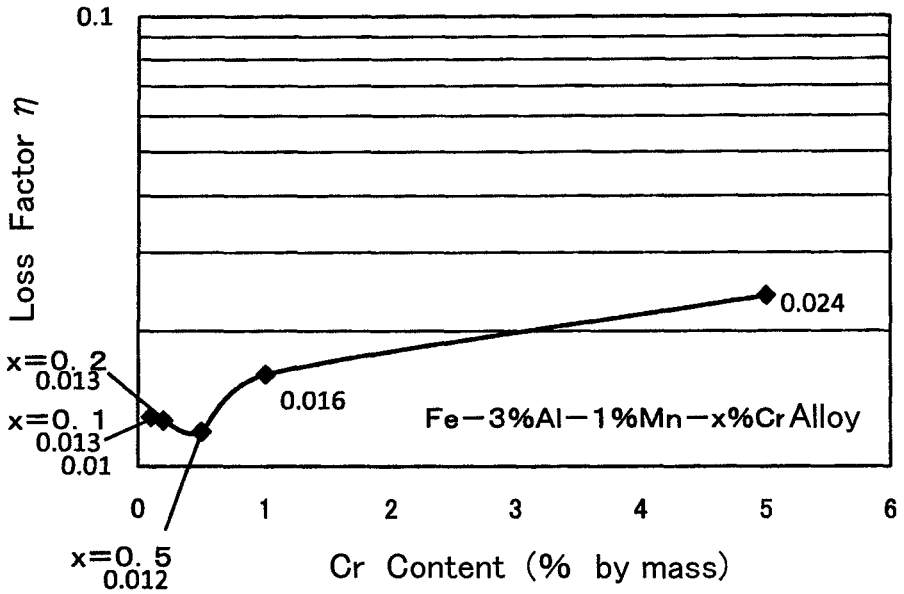
FIG. 4 is a dispersion diagram that illustrates a relationship between the Cr contents and loss factors of Fe—3% Al—1% Mn—"x"% Cr alloys.
Figure 5:
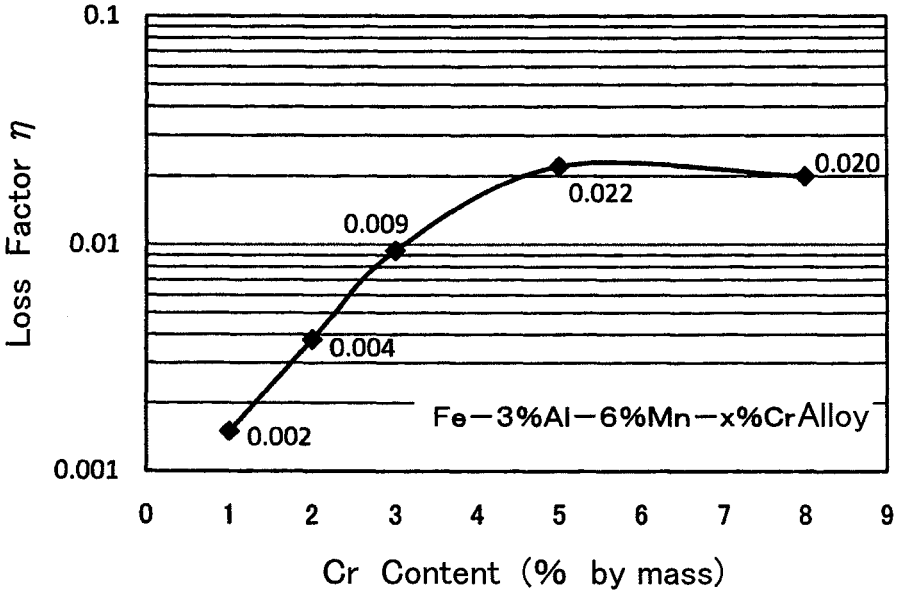
FIG. 5 is a dispersion diagram that illustrates a relationship between the Cr contents and loss factors of Fe—3% Al—6% Mn—"x"% Cr alloys.

As can be ascertained from Table 3 and FIG. 4, in iron alloys according to Test Specimen Nos. 2-1-1 through 2-1-3 in which the content of Cr in Test Specimen No. 2-1 was made 0.5% or less, the effect of the loss-factor augmentation resulting from the Cr addition was hardly appreciated. On the other hand, the loss factors augmented greatly in iron alloys according to Test Specimen Nos. 2-1-4 and 2-1-5 in which the content of Cr was made 1% or more. Therefore, it was understood that, even in iron alloys whose total amount of Al and Mn was less relatively, the damping properties of the iron alloys upgraded when the content of Cr was 1% or more.

Next, it was confirmed whether or not decline arose in the damping property of iron alloy in a case where the content of Cr was made greater. As can be ascertained from Table 3 and FIG. 5, in an iron alloy according to Test Specimen Nos. 2-3-5 in which the content of Cr was changed to 8% from 5%, namely, the content of Cr in Test Specimen No. 2-3, the loss factor was 0.020, namely, it did not decrease so much, compared with that of an iron alloy according to Test Specimen No. 2-3-4 whose content of Cr was 5%. That is, it was understood that, when the content of Cr was 8% or less at least, no decline arose in the damping property of iron alloy even due to the content of Cr that became too much. When taking the prospect of cost into consideration, it is adequate to set the upper-limit value of the Cr content at 8%.

(2) Magnetic Property and Damping Property

Figure 2:
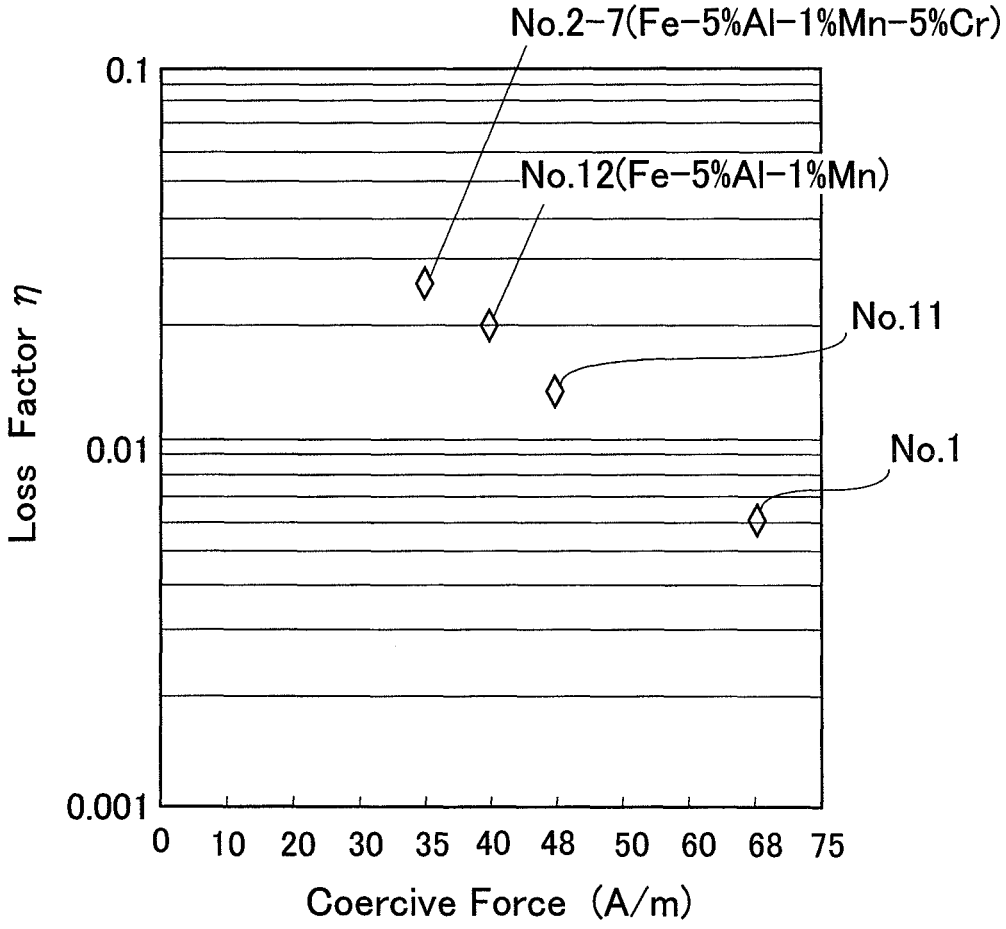
FIG. 2 is a dispersion diagram that illustrates relationships between the coercive forces and loss factors of iron alloys.

Test Specimen Nos. 1, 11 and 12, and Test Specimen No. 2-7 were picked up in order to illustrate correlations between their coercive forces and loss factors in FIG. 2.

As can be ascertained from FIG. 2, it was ascertained that there was such a tendency that the more the coercive force declined the more the loss factor increased. This represents that the more the coercive force declines the more likely the magnetic domain walls become to migrate so that a soft magnetic property grows, and thereby the damping property upgrades. Thus, the iron alloy according to the present invention is able to be not only ferromagnetic-type damping members but also soft-magnetic members, because the soft magnetic property and the damping property emerge concertedly.

(3) Strain Amplitude and Damping Property (e.g., Loss Factor)

Figure 3:
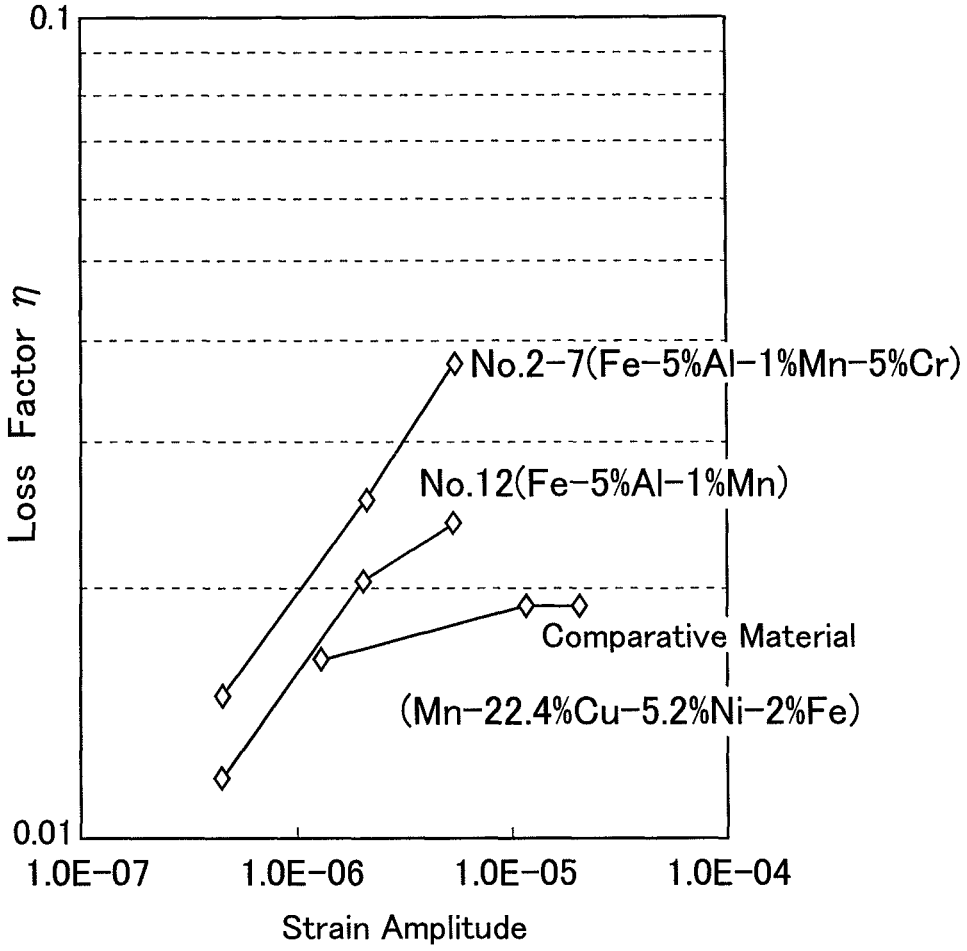
FIG. 3 is a dispersion diagram that illustrates relationships between the strain amplitudes and loss factors of damping materials.

Test Specimen No. 2-7 (Fe—5% Al—1% Mn—5% Cr) and Test Specimen No. 12 (Fe—5% Al—1% Mn (units: % by mass)), as well as a comparative material comprising an Mn—Cu-system alloy (Mn—22.4% Cu—5.2% Ni—2% Fe), were examined in order to illustrate correlations between their strain amplitudes and loss factors in FIG. 3.

As can be ascertained from FIG. 3, in the iron alloys according to the present invention, the loss factors became higher in such a low strain amplitude range as from $1\times10^{-6}$ to $1\times10^{-5}$; whereas, in the case of the comparative material, the loss factor became higher in a strain amplitude range (e.g., $1\times10^{-5}$ to $1\times10^{-4}$) that was larger than the former range From this fact, even when being simply referred as being damping materials, ranges (e.g., strain amplitude, and frequency), and the like, where the good damping property is expressed, depend on the damping materials. Therefore, in the case of discussing loss factors, it is needed to compare the loss factors after making it clear in which one of regions strain amplitudes are present.

TABLE 1

| | Alloy Composition (% by mass) | | Characteristics | | |
|---|---|---|---|---|---|
| No. | Al | Mn | Loss Factor η | Coercive Force (A/m) | Tensile Strength σ (MPa) |
| 1 | 2 | 0 | 0.0077 | 68 | 244 |
| 2 | 2 | 1 | 0.0089 | 65 | 255 |
| 3 | 2 | 4 | 0.0023 | 1194 | 350 |
| 4 | 2 | 8 | 0.0016 | 1273 | 525 |
| 5 | 3 | 0 | 0.0109 | 60 | 282 |
| 6 | 3.5 | 1 | 0.0114 | 59 | 300 |
| 7 | 3.5 | 5.2 | 0.0166 | 48 | 366 |
| 8 | 4 | 0 | 0.0161 | 49 | 314 |
| 9 | 4.2 | 1.8 | 0.0171 | 46 | 316 |
| 10 | 4.4 | 1 | 0.0141 | 53 | 319 |
| 11 | 5 | 0 | 0.0132 | 48 | 343 |
| 12 | 5 | 1 | 0.0204 | 40 | 348 |
| 13 | 5 | 4.2 | 0.0127 | 56 | 396 |
| 14 | 5 | 5 | 0.0152 | 51 | 416 |
| 15 | 5 | 8 | 0.0088 | 65 | 446 |

TABLE 2

| | Alloy Composition (% by mass) | | | Characteristics | | | |
|---|---|---|---|---|---|---|---|
| No. | Al | Mn | Cr | Loss Factor η | Tensile Strength (MPa) | 0.2% Proof Stress (MPa) | Elongation (%) |
| 2-1 | 3 | 1 | 1 | 0.016 | 293 | 196 | 32.1 |
| 2-2 | 3 | 2.8 | 5 | 0.026 | 342 | 253 | 42.9 |
| 2-3 | 3 | 6 | 5 | 0.022 | 350 | 287 | 25.0 |
| 2-4 | 4.8 | 1 | 1 | 0.021 | 325 | 252 | 35.7 |
| 2-5 | 5 | 1 | 1 | 0.027 | 353 | 272 | 30.4 |
| 2-6 | 5 | 1 | 3 | 0.032 | 366 | 299 | 25.0 |
| 2-7 | 5 | 1 | 5 | 0.028 | 378 | 313 | 62.5 |
| 2-8 | 5 | 1 | 7.5 | 0.026 | 382 | 319 | 25.0 |
| 2-9 | 5 | 5.1 | 5 | 0.026 | 432 | 349 | 21.4 |
| 2-10 | 5 | 6 | 1 | 0.021 | 434 | 354 | 28.6 |

TABLE 3

| | Alloy Composition (% by mass) | | | Characteristic |
|---|---|---|---|---|
| No. | Al | Mn | Cr | Loss Factor η |
| 2-1-1 | 3 | 1 | 0.1 | 0.013 |
| 2-1-2 | 3 | 1 | 0.2 | 0.013 |

TABLE 3-continued

| | Alloy Composition (% by mass) | | | Characteristic |
|---|---|---|---|---|
| No. | Al | Mn | Cr | Loss Factor η |
| 2-1-3 | 3 | 1 | 0.5 | 0.012 |
| 2-1-4 | 3 | 1 | 1 | 0.016 |
| 2-1-5 | 3 | 1 | 5 | 0.024 |
| 2-3-1 | 3 | 6 | 1 | 0.002 |
| 2-3-2 | 3 | 6 | 2 | 0.004 |
| 2-3-3 | 3 | 6 | 3 | 0.009 |
| 2-3-4 | 3 | 6 | 5 | 0.022 |
| 2-3-5 | 3 | 6 | 8 | 0.020 |

The invention claimed is:

1. An iron alloy being characterized in that:

it consists of aluminum (Al) in an amount of from 3 to 5.5% by mass (hereinafter being simply referred to as "%");

manganese (Mn) in an amount from 0.2 to 6%;

chromium (Cr) in an amount of from 1 to 8%; and the balance being iron (Fe), and inevitable impurities;

when the entirety is taken as 100%; and it exhibits a good damping property, or a soft magnetic property.

2. An iron-alloy member being characterized in that:

it is an iron-alloy member comprising the iron alloy as set forth in claim 1; and it is a damping member whose loss factor is 0.01, the loss factor indexing a damping property in a low-strain amplitude range of from $1\times10^{-6}$ to $1\times10^{-5}$, and in a frequency range of from 1,000 to 15,000 Hz.

3. An iron-alloy member being characterized in that:

it is an iron-alloy member comprising the iron alloy as set forth in claim 1;

it is a soft-magnetic member whose coercive force is 56 (A/m) or less.

4. A process for manufacturing iron-alloy member being characterized in that it is equipped with:

a hot working step of performing plastic processing onto an iron-alloy workpiece, which consists of: aluminum (Al) in an amount of from 3 to 5.5%; manganese (Mn) in an amount from 0.2 to 6%; chromium (Cr) in an amount of from 1 to 8%; and the balance being iron (Fe), and inevitable impurities; when the entirety is taken as 100%, at a hot working temperature that is equal to or higher than a recrystallization temperature of the iron-alloy workpiece; and an annealing step of heating the iron-alloy workpiece that is after being subjected to the hot working step to an annealing temperature that is higher than or equal to said recrystallization temperature, and thereafter cooling it gradually;

wherein an iron-alloy member that is made by forming said iron-alloy workpiece is obtainable.

5. The process for manufacturing iron-alloy member as set forth in claim 4 being further equipped with a cold working step of performing plastic processing, before said annealing step, onto said iron-alloy workpiece at a cold working temperature that is less than said recrystallization temperature.

6. The process for manufacturing iron-alloy member as set forth in claim 4, wherein said iron-alloy workpiece is a melt-produced material that has been melt produced in a vacuum.

* * * * *